US009990887B2

(12) United States Patent
Chen et al.

(10) Patent No.: US 9,990,887 B2
(45) Date of Patent: Jun. 5, 2018

(54) PIXEL DRIVING CIRCUIT, METHOD FOR DRIVING THE SAME, SHIFT REGISTER, DISPLAY PANEL AND DISPLAY DEVICE

(71) Applicants: BOE TECHNOLOGY GROUP CO., LTD., Beijing (CN); HEFEI XINSHENG OPTOELECTRONICS TECHNOLOGY CO., LTD., Anhui (CN)

(72) Inventors: Peng Chen, Beijing (CN); Xinxia Zhang, Beijing (CN)

(73) Assignees: BOE TECHNOLOGY GROUP, CO., LTD. (CN); HEFEI XINSHENG OPTOELECTRONICS TECHNOLOGY CO., LTD. (CN)

( * ) Notice: Subject to any disclaimer, the term of this patent is extended or adjusted under 35 U.S.C. 154(b) by 0 days. days.

(21) Appl. No.: 15/511,651

(22) PCT Filed: Mar. 1, 2016

(86) PCT No.: PCT/CN2016/075109

§ 371 (c)(1),
(2) Date: Mar. 16, 2017

(87) PCT Pub. No.: WO2016/169335

PCT Pub. Date: Oct. 27, 2016

(65) Prior Publication Data

US 2018/0033371 A1 Feb. 1, 2018

(30) Foreign Application Priority Data

Apr. 21, 2015 (CN) ..... 2015 1 0190626

(51) Int. Cl.
*G09G 3/32* (2016.01)
*G09G 3/3258* (2016.01)
(Continued)

(52) U.S. Cl.
CPC ..... *G09G 3/3258* (2013.01); *G09G 3/3266* (2013.01); *G09G 3/3291* (2013.01);
(Continued)

(58) Field of Classification Search
CPC .. G09G 3/3258; G09G 3/3266; G09G 3/3291; G09G 2300/0426; G09G 2310/0286; G09G 2320/043
(Continued)

(56) References Cited

U.S. PATENT DOCUMENTS

2003/0156084 A1* 8/2003 Tsuchiya ..... G09G 3/3233 345/84
2006/0253755 A1* 11/2006 Wu ..... G09G 3/3233 714/726
(Continued)

FOREIGN PATENT DOCUMENTS

CN 102122490 A 7/2011
CN 202939946 U 5/2013
(Continued)

OTHER PUBLICATIONS

International Search Report and Written Opinion for Application No. PCT/CN2016/075109, dated May 27, 2016, 14 Pages.
(Continued)

*Primary Examiner* — Stephen G Sherman
(74) *Attorney, Agent, or Firm* — Brooks Kushman P.C.

(57) ABSTRACT

A pixel driving circuit is provided. The pixel driving circuit includes a driving transistor (M1), a storage capacitor (Cs) and a data writing unit. The data writing unit is configured to receive an $n^{th}$-row scanning signal (Vscan (n)) and apply the data voltage (Vdata) to the gate electrode of the driving transistor (M1) in the case that the $n^{th}$-row scanning signal (Vscan (n)) is valid. The pixel driving circuit further includes: a reverse control unit, receiving an $(n-2)^{th}$-row scanning signal (Vscan (n−2)) and connected to the cathode of the OLED, and configured to control the cathode of the OLED to receive the $(n-2)^{th}$-row scanning signal (Vscan (n−2)) in the case that the $(n-2)^{th}$-row scanning signal (Vscan (n−2)) is valid. A voltage of the $(n-2)^{th}$-row scanning
(Continued)

signal (Vscan (n−2)) is greater than the driving voltage (Vdd), and n is an integer greater than 2.

20 Claims, 3 Drawing Sheets

(51) Int. Cl.
*G09G 3/3266* (2016.01)
*G09G 3/3291* (2016.01)

(52) U.S. Cl.
CPC ..... *G09G 2300/0426* (2013.01); *G09G 2310/0286* (2013.01); *G09G 2320/043* (2013.01)

(58) Field of Classification Search
USPC ..... 345/204, 76–83; 315/169.3
See application file for complete search history.

(56) References Cited

U.S. PATENT DOCUMENTS

| | | | | |
|---|---|---|---|---|
| 2012/0162176 | A1* | 6/2012 | Kim | G09G 3/3258 345/211 |
| 2016/0078808 | A1 | 3/2016 | Lin | |
| 2016/0125808 | A1 | 5/2016 | Hsu et al. | |

FOREIGN PATENT DOCUMENTS

| | | | |
|---|---|---|---|
| CN | 104217674 | A | 12/2014 |
| CN | 104269139 | A | 1/2015 |
| CN | 104464635 | A | 3/2015 |
| CN | 104751803 | A | 7/2015 |
| JP | 2003195808 | A | 7/2003 |
| JP | 2004361737 | A | 12/2004 |

OTHER PUBLICATIONS

First Office Action for Chinese Application No. 201510190626.8, dated Sep. 2, 2016, 6 Pages.
1St Chinese Office Action, English Translation.
International Search Report and Written Opinion, English Translation.
CN102122490A, English Abstract and Translation.
CN104217674A, English Abstract and Translation.
CN104269139A, English Abstract and U.S. Equivalent U.S. Pub. No. 2016/0078808.
CN104464635A, English Abstract and U.S. Equivalent U.S. Pub. No. 2016/0125808.
CN104751803A, English Abstract and Translation.
CN202939946U, English Abstract.
JP2003195808A, English Abstract and Translation.
JP2004361737A, English Abstract and Translation.

* cited by examiner

PIXEL DRIVING CIRCUIT, METHOD FOR DRIVING THE SAME, SHIFT REGISTER, DISPLAY PANEL AND DISPLAY DEVICE

CROSS-REFERENCE TO RELATED APPLICATION APPLICATIONS

This application is the U.S. national phase of PCT Application No. PCT/CN2016/075109 filed on Mar. 1, 2016, which claims priority to Chinese Patent Application No. 201510190626.8 filed on Apr. 21, 2015, the disclosures of which are incorporated in their entirety by reference herein.

TECHNICAL FIELD

The present disclosure relates to the field of display technology, and more particularly to a pixel driving circuit and a method for driving the pixel driving circuit, a shift register, a display panel and a display device.

BACKGROUND

An organic light-emitting diode (OLED) is a self-emitting light material, and has advantages of, for example, not requiring a back light plate, wide viewing angle, smooth image quality, quick response, easy colorization, being capable of emitting light through a simple driving circuit, simple manufacture procedure, being capable of being flexible, which is consistent with a principle of small-size and light-weight, therefore the OLED may be applied in various panels with any sizes.

A lifespan of an OLED has always been a key concern of all major manufacturers, and an aging occurs on the OLED itself during emitting light, which leads to a decline in luminance, wherein the aging mechanism includes defects in OLED devices, material deteriorations of the OLED itself and the like. In experiments, it is found that, after emitting light, the operation of applying a reverse voltage to the OLED extends the lifespan of the OLED. In conventional pixel driving circuit designs of active matrix organic light-emitting diodes (AMOLED), there are few pixel driving circuits capable of retarding an aging process of the OLED device itself.

SUMMARY

A main objective of the present disclosure is to provide a pixel driving circuit and a method for driving the pixel driving circuit, a shift register, a display panel and a display device, to provide a pixel driving circuit capable of retarding an aging process of the OLED device itself, and thus extend a lifespan of the OLED device.

In order to achieve the above objective, the present disclosure provides a pixel driving circuit configured to drive an organic light-emitting diode (OLED), wherein the pixel driving circuit includes a driving transistor, a storage capacitor and a data writing unit. A gate electrode of the driving transistor is configured to receive a data voltage through the data writing unit, a first electrode of the driving transistor is connected to a cathode of the OLED, and a second electrode of the driving transistor is grounded. The storage capacitor is connected between the gate electrode of the driving transistor and the first electrode of the driving transistor. An anode of the OLED is configured to receive a driving voltage. The data writing unit is configured to receive an $n^{th}$-row scanning signal and apply the data voltage to the gate electrode of the driving transistor in the case that the $n^{th}$-row scanning signal is valid. The pixel driving circuit further includes: a reverse control unit, receiving an $(n-2)^{th}$-row scanning signal and connected to the cathode of the OLED, and configured to control the cathode of the OLED to receive the $(n-2)^{th}$-row scanning signal in the case that the $(n-2)^{th}$-row scanning signal is valid; a voltage of the $(n-2)^{th}$-row scanning signal is greater than the driving voltage, and n is an integer greater than 2.

During the implementation, the reverse control unit includes a reverse control transistor, wherein a gate electrode and a first electrode of the reverse control transistor are each configured to receive the $(n-2)^{th}$-row scanning signal, and a second electrode of the reverse control transistor is connected to the cathode of the OLED.

During the implementation, the pixel driving circuit according to the present disclosure further includes: a switch control unit, receiving an $(n-1)^{th}$-row scanning signal and connected to the anode and the cathode of the OLED, and configured to control the anode and the cathode of the OLED and the anode of the OLED to be electrically connected to each other in the case that the $(n-1)^{th}$-row scanning signal is valid.

During the implementation, the switch control unit includes: a switch controlling transistor, wherein a gate electrode of the switch controlling transistor is configured to receive the $(n-1)^{th}$-row scanning signal, a first electrode of the switch controlling transistor is connected to the anode of the OLED, and a second electrode of the switch controlling transistor is connected to the cathode of the OLED.

During the implementation, the data writing unit includes: a data writing transistor, wherein a gate electrode of the data writing transistor is configured to receive the $n^{th}$-row scanning signal, a first electrode of the data writing transistor is configured to receive a data voltage, and a second electrode of the data writing transistor is connected to the gate electrode of the driving transistor.

The present disclosure further provides a driving method for driving the above pixel driving circuit, including: controlling the cathode of the OLED to receive the $(n-2)^{th}$-row scanning signal in the case that the (n−2)th-row scanning signal is valid; a voltage of the $(n-2)^{th}$-row scanning signal is greater than the driving voltage, and n is an integer greater than 2; and applying, by the data writing unit, the data voltage to the gate electrode of the driving transistor in the case that the $n^{th}$-row scanning signal is valid.

During the implementation, the driving method according to the present disclosure further includes: controlling, by the switch control unit, the anode and cathode of the OLED to be electrically connected to each other in the case that an $(n-1)^{th}$-row scanning signal is valid.

The present disclosure further provides a shift register, including N levels of the above pixel driving circuits, N being an integer greater than 2; an $n^{th}$-level pixel driving circuit is configured to receive the $n^{th}$-row scanning signal and the $(n-2)^{th}$-row scanning signal, and n is an integer greater than 2 and less than or equal to N.

During the implementation, the $n^{th}$-level pixel driving circuit is further configured to receive the $(n-1)^{th}$-row scanning signal.

The present disclosure further provides a display panel including the above shift register.

The present disclosure further provides a display device including the above described display panel.

Compared with a related art, in the pixel driving circuit and the method for driving the pixel driving circuit, the shift register, the display panel and the display device according to the present disclosure, a reverse voltage is applied across two ends of the OLED at the end of the period for displaying one frame image, so as to retard an aging process of the OLED device, and extend the lifespan of the OLED.

DETAILED DESCRIPTION

In order to make the objective, the technical solutions and the advantages of the present disclosure more apparent, the present disclosure will be described hereinafter in a clear and complete manner in conjunction with the drawings and embodiments. Obviously, the following embodiments merely relate to a part of, rather than all of, the embodiments of the present disclosure, and based on these embodiments, a person skilled in the art may, without any creative effort, obtain the other embodiments, which also fall within the scope of the present disclosure.

Unless otherwise defined, any technical or scientific term used herein shall have the common meaning understood by a person of ordinary skills. Such words as "first" and "second" used in the specification and claims are merely used to differentiate different components rather than to represent any order, number or importance. Similarly, such words as "one" or "a" are merely used to represent the existence of at least one member, rather than to limit the number thereof. Such words as "connect" or "connected to" may include electrical connection, direct or indirect, rather than to be limited to physical or mechanical connection. Such words as "on", "under", "left" and "right" are merely used to represent relative position relationship, and when an absolute position of the object is changed, the relative position relationship will be changed too.

Transistors used in all embodiments of the present disclosure each may be a thin film transistor, a field effect transistor, or other devices with same characteristics. In embodiments of the present disclosure, in order to distinguish two electrodes, except for the gate electrode, of a transistor, one electrode of which is called a first electrode, and the other one electrode is called a second electrode, wherein the first electrode may be a source electrode or a drain electrode, accordingly, the second electrode may be a drain electrode or a source electrode. In addition, transistors may be classified into n-type transistors and p-type transistors according to characteristics of transistors. In the driving circuits provided by the embodiments of the present disclosure, as an example, all of the transistors are the n-type transistors, but it should be appreciated that, during the implementation, using the p-type transistors are easily conceivable by a person skilled in the art without any creative labor, which also fall within the scope of embodiments of the present disclosure.

Figure 1:
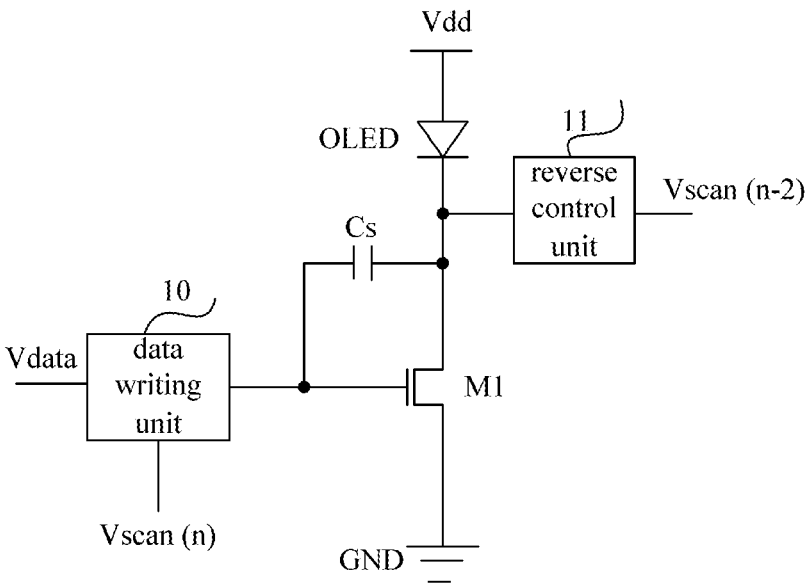
FIG. 1 is a structure diagram of a pixel driving circuit according to one embodiment of the present disclosure.

As shown in FIG. 1, the pixel driving circuit according to the embodiments of the present disclosure, is configured to drive an light-emitting diode (OLED), and includes a driving transistor M1, a storage capacitor Cs, and a data writing unit 10. A gate electrode of the driving transistor M1 is configured to receive a data voltage Vdata through the data writing unit 10, a first electrode of the driving transistor M1 is connected to a cathode of the OLED, and a second electrode of the driving transistor M1 is connected to ground GND. The storage capacitor Cs is connected between the gate electrode of the driving transistor M1 and the first electrode of the driving transistor M1. An anode of the OLED is configured to receive a driving voltage Vdd. The data writing unit 10 is configured to receive an $n^{th}$-row scanning signal Vscan (n) and apply the data voltage Vdata to the gate electrode of the driving transistor M1 in the case that the $n^{th}$-row scanning signal Vscan (n) is valid.

The pixel driving circuit further includes: a reverse control unit 11, receiving an $(n-2)^{th}$-row scanning signal Vscan (n−2) and connected to the cathode of the OLED, and configured to control the cathode of the OLED to receive the $(n-2)^{th}$-row scanning signal Vscan (n−2) in the case that the $(n-2)^{th}$-row scanning signal Vscan (n−2) is valid, such that a reverse voltage is applied across two ends of the OLED; a voltage of the $(n-2)^{th}$-row scanning signal Vscan (n−2) is greater than the driving voltage Vdd, and n is an integer greater than 2.

In the embodiment of the pixel driving circuit as shown in FIG. 1, the driving transistor M1 is an n-type thin film transistor (TFT); however, during the actual implementation, the driving transistor M1 may also be replaced with a p-type TFT, and such replacement has been commonly known to a person skilled in the art, which is not repeated herein.

In the pixel driving circuit according to the embodiment as shown in FIG. 1, it enables to, through using a reverse control unit, control a reverse voltage to be applied across two ends of the OLED at the end of the period for displaying one frame image, meanwhile the OLED is turned off and does not emit any light. As a result, it is capable of retarding both an aging process of the OLED device and the luminance degradation of the OLED while using the existing scanning signal without adding a new control signal, which extends the lifespan of the OLED.

Figure 2:
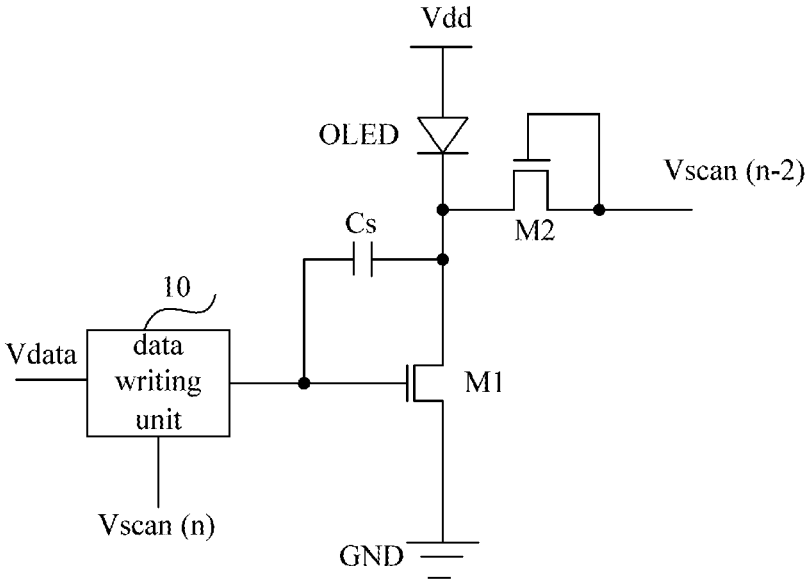
FIG. 2 is a structure diagram of a pixel driving circuit according to another embodiment of the present disclosure.

Specifically, as shown in FIG. 2, the reverse control unit 11 may include a reverse control transistor M2, wherein a gate electrode and a first electrode of the reverse control transistor M2 are each configured to receive the $(n-2)^{th}$-row scanning signal Vscan (n−2), and a second electrode of the reverse control transistor M2 is connected to the cathode of the OLED.

In the embodiment as shown in FIG. 2, the reverse control transistor M2 is an n-type TFT. However, during the actual implementation, the reverse control transistor M2 may also be replaced with a p-type TFT by just changing the polarity of the $(n-2)^{th}$-row scanning signal Vscan (n−2) accordingly, and such replacement has been commonly known to a person skilled in the art, which shall not be repeated herein.

In the case that the $(n-2)^{th}$-row scanning signal Vscan (n−2) is valid (i.e., the $(n-2)^{th}$-row scanning signal Vscan (n−2) is of a high level), the reverse control transistor M2 is turned on, such that the cathode of the OLED receives the $(n-2)^{th}$-row scanning signal Vscan (n−2). At this point, since the voltage of the $(n-2)^{th}$-row scanning signal Vscan (n−2) is greater than the driving voltage Vdd, a reverse voltage is applied across both ends of the OLED, meanwhile the OLED is turned off and does not emit any light. As a result, it is capable of retarding both an aging process of the OLED device and the luminance degradation of the OLED, which extends the lifespan of the OLED.

Figure 3:
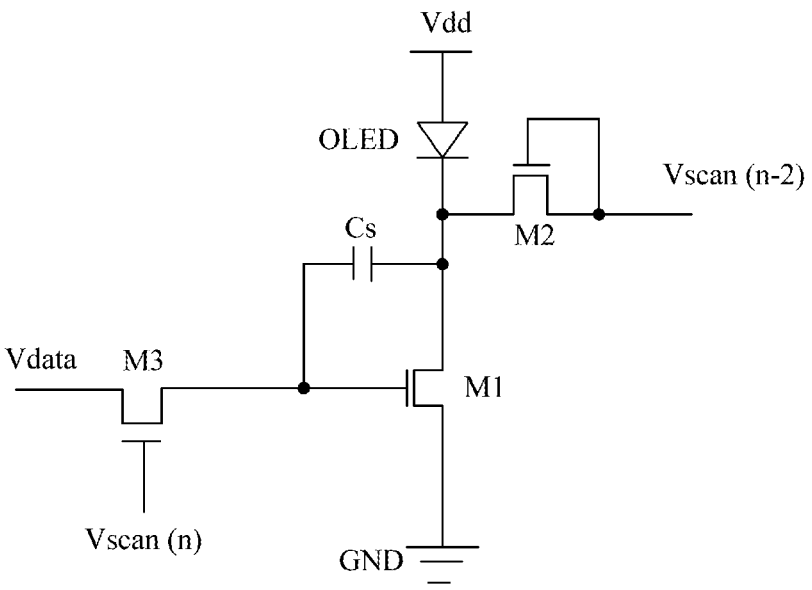
FIG. 3 is a circuit diagram of a pixel driving circuit according to yet another embodiment of the present disclosure.

During the specific implementation, as shown in FIG. 3, the data writing unit 10 may include a data writing transistor M3. A gate electrode of the data writing transistor M3 is configured to receive an $n^{th}$-row scanning signal Vscan (n), a first electrode of the data writing transistor M3 is configured to receive a data voltage Vdata, and a second electrode of the data writing transistor M3 is connected to the gate electrode of the driving transistor M1.

In the embodiment of the pixel driving circuit as shown in FIG. 3, the data writing transistor M3 is an n-type TFT. However, during the actual implementation, the reverse control transistor M2 may also be replaced with a p-type TFT by just changing the polarity of the $n^{th}$-row scanning signal Vscan (n) accordingly, and such replacement has been commonly known to a person skilled in the art, which shall not be repeated herein.

In the case that the $n^{th}$-row scanning signal Vscan (n) is valid (i.e., the $n^{th}$-row scanning signal Vscan (n) is of a high level), the data writing transistor M3 is turned on, and the data voltage Vdata is applied to the gate electrode of the driving transistor M1.

Figure 4:
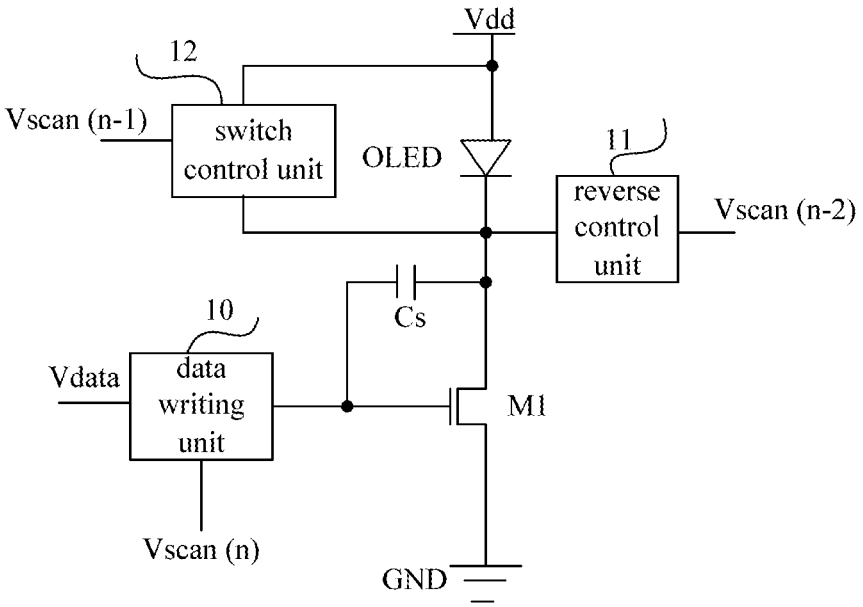
FIG. 4 is a structure diagram of a pixel driving circuit according to still another embodiment of the present disclosure.

Alternatively, as shown in FIG. 4, the pixel driving circuit according to the present disclosure further includes: a switch control unit 12, receiving an $(n-1)^{th}$-row scanning signal Vscan (n−1) and connected to the anode and the cathode of the OLED, and configured to control the anode and the cathode of the OLED to be electrically connected to each other in the case that the $(n-1)^{th}$-row scanning signal Vscan (n−1) is valid, such that both ends of the OLED are of an identical level, and the OLED is turned off and does not emit any light, which does not affect the data writing unit 10 controlled by the $n^{th}$-row scanning signal Vscan (n) to apply the data voltage Vdata into the gate electrode of the driving transistor M1.

Specifically, the switch control unit may include: a switch controlling transistor, wherein a gate electrode of the switch controlling transistor is configured to receive the $(n-1)^{th}$-row scanning signal, a first electrode of the switch controlling transistor is connected to the anode of the OLED, and a second electrode of the switch controlling transistor is connected to the cathode of the OLED.

In the following, the pixel driving circuit according to the present disclosure will be further described in conjunction with a specific embodiment.

Figure 5:
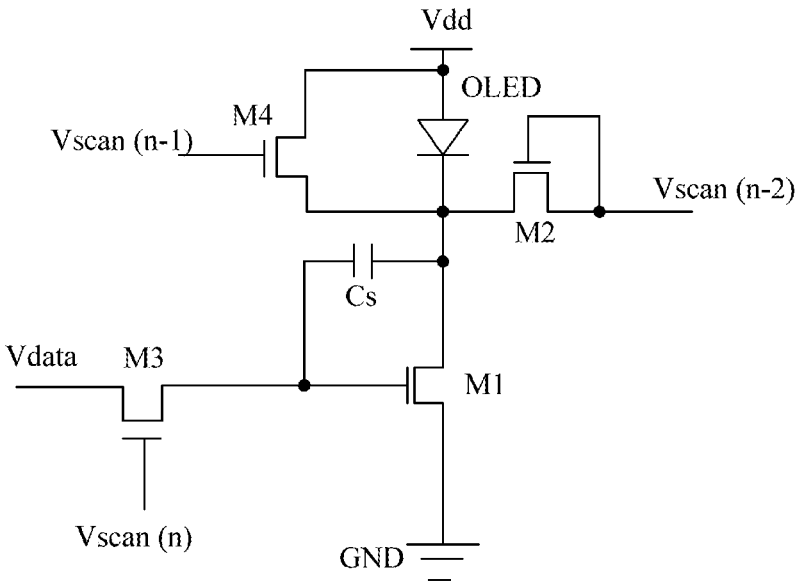
FIG. 5 is a circuit diagram of a pixel driving circuit according to a specific embodiment of the present disclosure.

As shown in FIG. 5, the pixel driving circuit according to a specific embodiment of the present disclosure includes a driving transistor M1, a storage capacitor Cs, a reverse control transistor M2, a data writing transistor M3 and a switch controlling transistor M4. A gate electrode of the driving transistor M1 is configured to receive data voltage Vdata through the data writing unit 10, a first electrode of the driving transistor M1 is connected to a cathode of the OLED, and a second electrode of the driving transistor M1 is connected to ground GND. The storage capacitor Cs is connected between the gate electrode of the driving transistor M1 and the first electrode of the driving transistor M1. An anode of the OLED is configured to receive a driving voltage Vdd. A gate electrode and a first electrode of the reverse control transistor M2 are each configured to receive the $(n-2)^{th}$-row scanning signal Vscan (n−2), and a second electrode of the reverse control transistor M2 is connected to the cathode of the OLED. A gate electrode of the data writing transistor M3 is configured to receive an $n^{th}$-row scanning signal Vscan (n), a first electrode of the data writing transistor M3 is configured to receive a data voltage Vdata, and a second electrode of the data writing transistor M3 is connected to the gate electrode of the driving transistor M1. A gate electrode of the switch controlling transistor M4 is configured to receive the $(n-1)^{th}$-row scanning signal Vscan (n−1), a first electrode of the switch controlling transistor M4 is connected to the anode of the OLED, and a second electrode of the switch controlling transistor M4 is connected to the cathode of the OLED. The driving transistor M1, the reverse control transistor M2, the data writing transistor M3 and the switch controlling transistor M4 are all n-type TFTs.

During an operation of the pixel driving circuit according to the specific embodiment of the present disclosure, at a final phase of the process for displaying the one frame image (i.e., before the next light-emitting of the OLED), the $(n-2)^{th}$-row scanning signal Vscan (n−2) is introduced to turn on the reverse control transistor M2, such that a reverse voltage is applied across the two ends of the OLED, meanwhile the OLED is turned off and does not emit any light. As a result, a defect due to apply a forward voltage to the OLED is eliminated, and it enables to extend a lifespan extension of the OLED. Subsequently, the $(n-1)^{th}$-row scanning signal Vscan (n−1) is applied, such that the switch controlling transistor M4 is turned on, while the reverse control transistor M2 is turned off, the electric potentials at both ends of the OLED are equal, and the OLED is turned off and does not emit any light, which does not affect the data writing transistor M3 to be turned on by the $n^{th}$-row scanning signal Vscan (n) to introduce the data voltage Vdata. In addition, since the scanning signal is at the high level in a very short time period, which is too short to be recognized by the human's eyes, and thus does not affect the display effect of the AMOLED display panel.

The method for driving the pixel driving circuit according to embodiments of the present disclosure is configured to drive the above described pixel driving circuit. The driving method includes: controlling the cathode of the OLED to receive the $(n-2)^{th}$-row scanning signal in the case that the $(n-2)^{th}$-row scanning signal is valid. A voltage of the $(n-2)^{th}$-row scanning signal is greater than the driving voltage, and n is an integer greater than 2. In the case that the $n^{th}$-row scanning signal is valid, the data voltage writing unit controls to apply the data voltage to the gate electrode of the driving transistor.

Specifically, the driving method according to present disclosure further includes: controlling, by the switch control unit, the anode and the cathode of the OLED to be electrically connected to each other in the case that an $(n-1)^{th}$-row scanning signal is valid.

The shift register according to embodiment of the present disclosure includes N levels of the above described pixel driving circuits, and N is an integer greater than 2. An $n^{th}$-level pixel driving circuit is configured to receive the $n^{th}$-row scanning signal and the $(n-2)^{th}$-row scanning signal, and n is an integer greater than 2 and less than or equal to N.

Specifically, the $n^{th}$-level pixel driving circuit is further configured to receive the $(n-1)^{th}$-row scanning signal.

A display panel according to embodiments of the present disclosure includes the above described shift register.

The display device according to embodiments of the present disclosure includes the above described display panel.

The display device may be any product or component having a display function, such as an electronic paper, an OLED display device, a mobile phone, a tablet computer, a television, a monitor, a notebook computer, a digital photo frame, or a navigator.

The above are merely the preferred embodiments of the present disclosure. A person skilled in the art may make further modifications and improvements without departing from the principle of the present disclosure, and these modifications and improvements shall also fall within the scope of the present disclosure.

What is claimed is:

1. A pixel driving circuit, configured to drive an organic light-emitting diode (OLED), wherein the pixel driving circuit comprises a driving transistor, a storage capacitor and a data writing unit, wherein a gate electrode of the driving transistor is configured to receive a data voltage through the data writing unit, a first electrode of the driving transistor is connected to a cathode of the OLED, and a second electrode of the driving transistor is grounded; the storage capacitor is connected between the gate electrode of the driving transistor and the first electrode of the driving transistor; an anode of the OLED is configured to receive a driving voltage; the data writing unit is configured to receive an $n^{th}$-row scanning signal and apply the data voltage to the gate electrode of the driving transistor when the $n^{th}$-row scanning signal is valid, wherein the pixel driving circuit further comprises:

a reverse control unit, receiving an $(n-2)^{th}$-row scanning signal and connected to the cathode of the OLED, and configured to control the cathode of the OLED to receive the $(n-2)^{th}$-row scanning signal when the $(n-2)^{th}$-row scanning signal is valid, wherein a voltage of the $(n-2)^{th}$-row scanning signal is greater than the driving voltage, and n is an integer greater than 2.

2. The pixel driving circuit according to claim 1, wherein the reverse control unit comprises a reverse control transistor, wherein a gate electrode and a first electrode of the reverse control transistor are each configured to receive the $(n-2)^{th}$-row scanning signal, and a second electrode of the reverse control transistor is connected to the cathode of the OLED.

3. The pixel driving circuit according to claim 2, further comprising:

a switch control unit, receiving an $(n-1)^{th}$-row scanning signal and connected to the anode and the cathode of the OLED, and configured to control the anode and the cathode of the OLED to be electrically connected to each other when the $(n-1)^{th}$-row scanning signal is valid.

4. The pixel driving circuit according to claim 3, wherein the switch control unit comprises:

a switch controlling transistor, wherein a gate electrode of the switch controlling transistor is configured to receive the $(n-1)^{th}$-row scanning signal, a first electrode of the switch controlling transistor is connected to the anode of the OLED, and a second electrode of the switch controlling transistor is connected to the cathode of the OLED.

5. The pixel driving circuit according to claim 2, wherein the data writing unit comprises:

a data writing transistor, wherein a gate electrode of the data writing transistor is configured to receive the $n^{th}$-row scanning signal, a first electrode of the data writing transistor is configured to receive a data voltage, and a second electrode of the data writing transistor is connected to the gate electrode of the driving transistor.

6. A method for driving the pixel driving circuit according to claim 2, comprising:

controlling the cathode of the OLED to receive the $(n-2)^{th}$-row scanning signal when the $(n-2)^{th}$-row scanning signal is valid, wherein a voltage of the $(n-2)^{th}$-row scanning signal is greater than the driving voltage, and n is an integer greater than 2; and applying, by the data writing unit, the data voltage to the gate electrode of the driving transistor when the $n^{th}$-row scanning signal is valid.

7. The pixel driving circuit according to claim 1, further comprising:

a switch control unit, receiving an $(n-1)^{th}$-row scanning signal and connected to the anode and the cathode of the OLED, and configured to control the anode and the cathode of the OLED to be electrically connected to each other when the $(n-1)^{th}$-row scanning signal is valid.

8. The pixel driving circuit according to claim 7, wherein the switch control unit comprises:

a switch controlling transistor, wherein a gate electrode of the switch controlling transistor is configured to receive the $(n-1)^{th}$-row scanning signal, a first electrode of the switch controlling transistor is connected to the anode of the OLED, and a second electrode of the switch controlling transistor is connected to the cathode of the OLED.

9. The pixel driving circuit according to claim 8, wherein the data writing unit comprises:

a data writing transistor, wherein a gate electrode of the data writing transistor is configured to receive the $n^{th}$-row scanning signal, a first electrode of the data writing transistor is configured to receive a data voltage, and a second electrode of the data writing transistor is connected to the gate electrode of the driving transistor.

10. The pixel driving circuit according to claim 8, wherein the data writing unit comprises:

a data writing transistor, wherein a gate electrode of the data writing transistor is configured to receive the $n^{th}$-row scanning signal, a first electrode of the data writing transistor is configured to receive a data voltage, and a second electrode of the data writing transistor is connected to the gate electrode of the driving transistor.

11. A method for driving the pixel driving circuit according to claim 8, comprising:

controlling the cathode of the OLED to receive the $(n-2)^{th}$-row scanning signal when the $(n-2)^{th}$-row scanning signal is valid, wherein a voltage of the $(n-2)^{th}$-row scanning signal is greater than the driving voltage, and n is an integer greater than 2; and applying, by the data writing unit, the data voltage to the gate electrode of the driving transistor when the $n^{th}$-row scanning signal is valid.

12. The method according to claim 11, further comprises:

controlling, by the switch control unit, the anode and the cathode of the OLED to be electrically connected to each other when an $(n-1)^{th}$-row scanning signal is valid.

13. A method for driving the pixel driving circuit according to claim 7, comprising:

controlling the cathode of the OLED to receive the $(n-2)^{th}$-row scanning signal when the $(n-2)^{th}$-row scanning signal is valid, wherein a voltage of the $(n-2)^{th}$-row scanning signal is greater than the driving voltage, and n is an integer greater than 2; and applying, by the data writing unit, the data voltage to the gate electrode of the driving transistor when the $n^{th}$-row scanning signal is valid.

14. The method according to claim 13, further comprises:

controlling, by the switch control unit, the anode and the cathode of the OLED to be electrically connected to each other when an $(n-1)^{th}$-row scanning signal is valid.

15. The pixel driving circuit according to claim 7, wherein the data writing unit comprises:

a data writing transistor, wherein a gate electrode of the data writing transistor is configured to receive the $n^{th}$-row scanning signal, a first electrode of the data writing transistor is configured to receive a data voltage, and a second electrode of the data writing transistor is connected to the gate electrode of the driving transistor.

16. A method for driving the pixel driving circuit according to claim 1, comprising:

controlling the cathode of the OLED to receive the $(n-2)^{th}$-row scanning signal when the $(n-2)^{th}$-row scanning signal is valid, wherein a voltage of the $(n-2)^{th}$-row scanning signal is greater than the driving voltage, and n is an integer greater than 2; and applying, by the data writing unit, the data voltage to the gate electrode of the driving transistor when the $n^{th}$-row scanning signal is valid.

17. A shift register, comprising N levels of the pixel driving circuits according to claim 1, N being an integer greater than 2, wherein an $n^{th}$-level pixel driving circuit is configured to receive the $n^{th}$-row scanning signal and the $(n-2)^{th}$-row scanning signal, and n is an integer greater than 2 and less than or equal to N.

18. The shift register according to claim 17, wherein the $n^{th}$-level pixel driving circuit is further configured to receive the $(n-1)^{th}$-row scanning signal.

19. A display panel, comprising the shift register according to claim 17.

20. A display device, comprising the display panel according to claim 19.

* * * * *